US005642755A

United States Patent [19]

Mark et al.

[11] Patent Number: 5,642,755

[45] Date of Patent: Jul. 1, 1997

[54] FAUCET

[75] Inventors: Darren M. Mark, Castaic; Donald J. Segien, Jr., Chatsworth; Curtis S. Woolley, Granada Hills, all of Calif.

[73] Assignee: Emhart Inc., Newark, Del.

[21] Appl. No.: 535,692

[22] Filed: Sep. 28, 1995

[51] Int. Cl.[6] ..... E03C 1/04

[52] U.S. Cl. ..... 137/801; 4/676; 137/359; 137/606

[58] Field of Search ..... 4/676; 137/359, 137/606, 801

[56] References Cited

U.S. PATENT DOCUMENTS

| | | | |
|---|---|---|---|
| 3,010,474 | 11/1961 | Moen | 137/359 |
| 4,356,574 | 11/1982 | Johnson . | |
| 4,387,738 | 6/1983 | Bisonaya . | |
| 4,513,769 | 4/1985 | Purcell . | |
| 5,073,991 | 12/1991 | Marty . | |
| 5,131,428 | 7/1992 | Bory . | |
| 5,165,121 | 11/1992 | McTargett et al. | 137/801 X |
| 5,368,071 | 11/1994 | Hsieh . | |

FOREIGN PATENT DOCUMENTS

| | | |
|---|---|---|
| 3522390A1 | 1/1987 | Germany . |
| 2251787 | 7/1992 | United Kingdom . |

*Primary Examiner*—Gerald A. Michalsky
*Attorney, Agent, or Firm*—J. Bruce Hoofnagle

[57] ABSTRACT

A faucet 30 includes a housing 32 having a base 34 and a spout 36. The base 34 and the spout 36 are each formed with an opening which communicate with each other to form an opening of the housing. A putty plate 54 is formed in a configuration similar to a configuration of the opening of the base 34. The putty plate is formed with a ledge 57 on which is formed a pair of spaced "L" shaped channels 80 and a locking tab 76 with a latch bar 78. A throat plate 104 is formed with a body 106 with a ledge 116 extending therefrom. The ledge 116 is formed with a pair of spaced tabs 118 and 120 extending from one side of the ledge and an elongated hole 122 formed in the ledge between the tabs. A pair of bosses 124 and 126 with holes 128 are formed in spaced portions of the body 106. The tabs 118 and 120 of the throat plate 104 are located in the channels 80 of the putty plate 54 and the latch bar 78 is located in the hole 122 to retain the throat plate with the putty plate as an assembly. The assembly of the throat plate 104 and the putty plate 54 is then positioned within the opening of the housing and the putty plate is secured to the base 34 and the throat plate is secured to the spout 36.

19 Claims, 12 Drawing Sheets

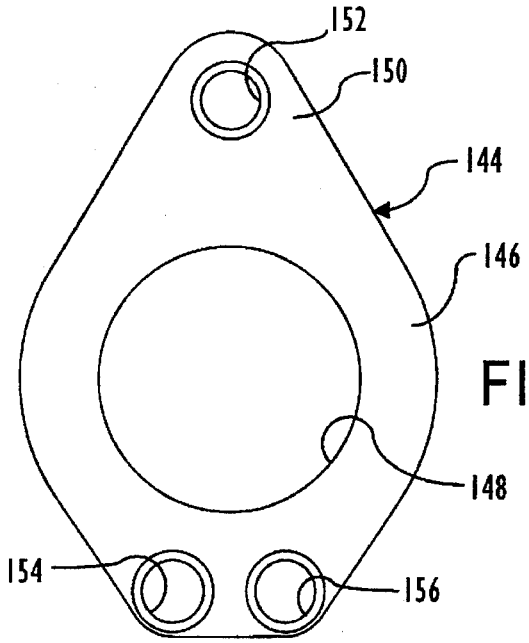
FIG. 19
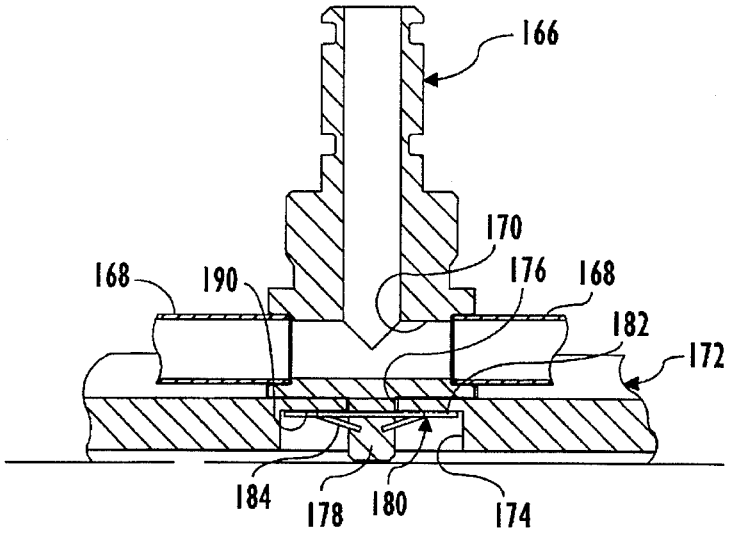
FIG. 20
FIG. 21
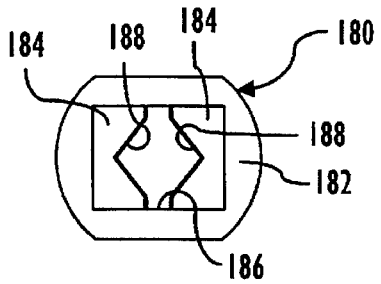
FIG. 22
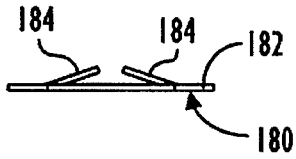

FAUCET

BACKGROUND OF THE INVENTION

This invention relates to a faucet and particularly to a faucet assembly which includes a faucet housing, putty plate and throat plate.

One type of faucet includes a housing shell having a base and a spout formed as a single unit. The housing shell includes an opening which is formed by an opening of the base and an opening of the spout which communicate with each other. Water transporting facilities are mounted within the housing shell through the opening thereof to facilitate use of the faucet in a well known manner.

Typically, some form of covering is placed over the openings of the base and the spout to complete the assembly. In some instances, a cover referred to as a putty plate is placed over the opening of the base and is secured thereto. Another cover referred to as a throat plate is placed over the opening of the spout and is secured thereto complete a two-cover assembly. Still another type of cover is formed as a single molded unit including a throat plate section and a putty plate, or base cover, section.

While the single-unit cover facilitates less handling during an assembly operation than the two-cover assembly, the throat plate section and the putty plate section are composed of the same material. In many instances, it is desirable to have a throat plate which is capable of providing a decorative surface finish than would be required for the putty plate. For example, the putty plate could be made from plastic and the throat plate is made from a metal capable providing the surface finish. In these instances, the advantages of the single-unit cover are lost and the putty plate has to be assembled with the housing independently of the throat plate.

Thus, there is a need for readily assembling a putty plate and a throat plate as a single assembly to gain the advantage of simplified handling of the assembly during the process of assembling the assembly with the housing.

Also, when the putty plate and the throat plate are assembled with the housing as separate elements, each of the elements is attached to the housing only. If they could be attached to each other, in addition to being attached separately to the housing, the final assembly of the housing, putty plate and throat plate would be much stronger, integrally joined assembly.

Thus, there is a need for the ability to readily assemble a putty plate and a throat plate together as a integral unit for subsequent assembly with a faucet housing.

SUMMARY OF THE INVENTION

In view of the foregoing needs, it is an object of this invention to provide an assembly of a putty plate and a throat plate which can be readily assembled with a faucet housing.

Another object of this invention is to provide a readily assembled putty plate and a throat plate to facilitate efficient and easy handling during assembly thereof with a faucet housing.

With these and other objects in mind, this invention contemplates a faucet having a putty plate attached to a throat plate to form an assembly. The faucet also includes a housing formed in a shell-like configuration with an opening formed therein. The assembly of the putty plate and the throat plate is located within the opening of the housing and is connected to the housing in this position.

Other objects, features and advantages for the present invention will become more fully apparent from the following detailed description of the preferred embodiment, the appended claims and the accompanying drawings.

BRIEF DESCRIPTION OF THE DRAWINGS

In the accompanying drawings:

FIG. 19 is a top view of the bracket of FIG. 18;

FIG. 20 is a sectional view of a putty plate in assembly with a center body and held there by a press nut in accordance with certain principles of the invention;

FIG. 21 is a top view showing the press nut of FIG. 20;

FIG. 22 is a side view showing the press nut of FIG. 20;

DESCRIPTION OF THE PREFERRED EMBODIMENT

Figure 1:
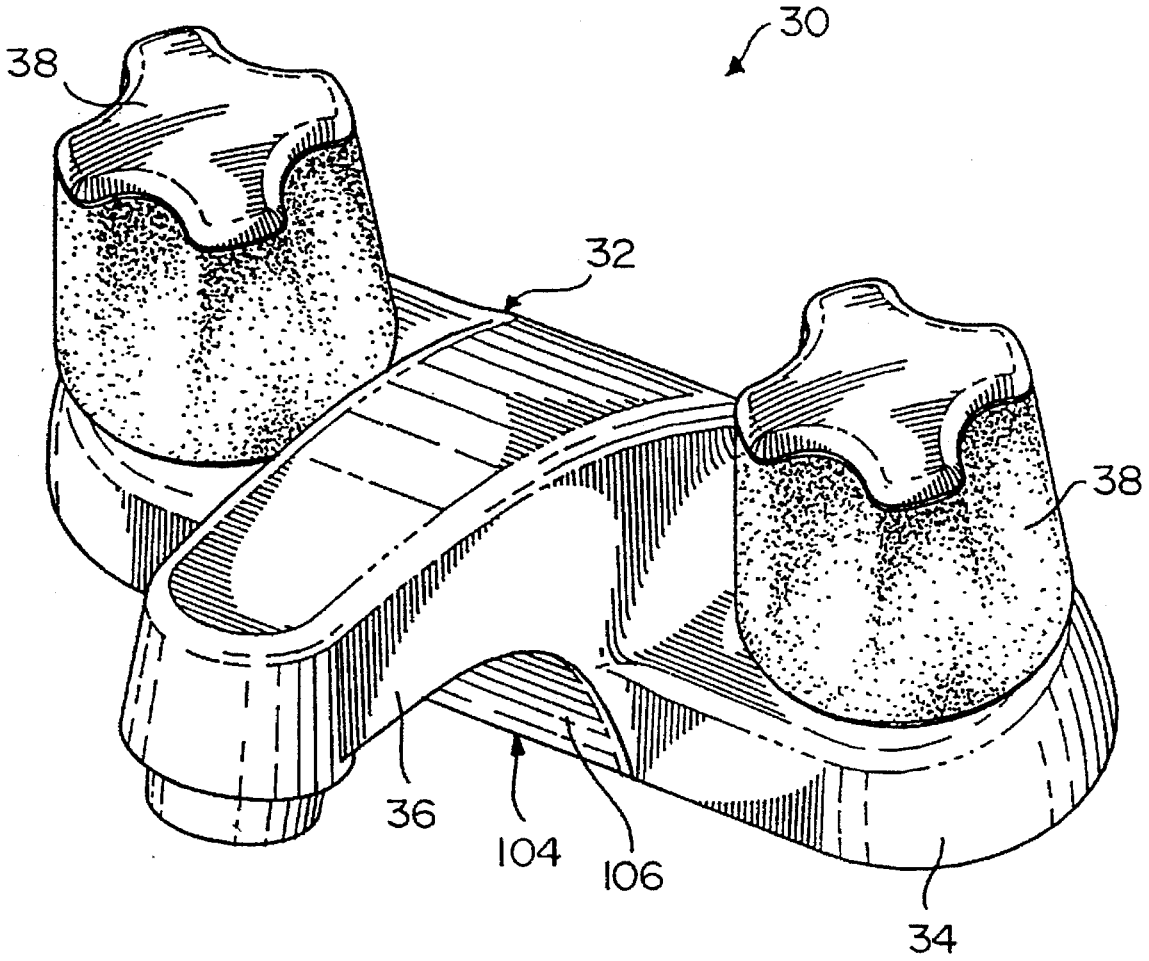
FIG. 1 is a perspective view showing a faucet.

As shown in FIG. 1, a faucet 30, depicting the preferred embodiment of the invention, is formed with a housing 32 having a base 34 and a spout 36 extending outward from a central portion thereof. A pair of handles 38 are located on the top of the base 34 on opposite sides of a rear portion of the spout 36.

Figure 2:
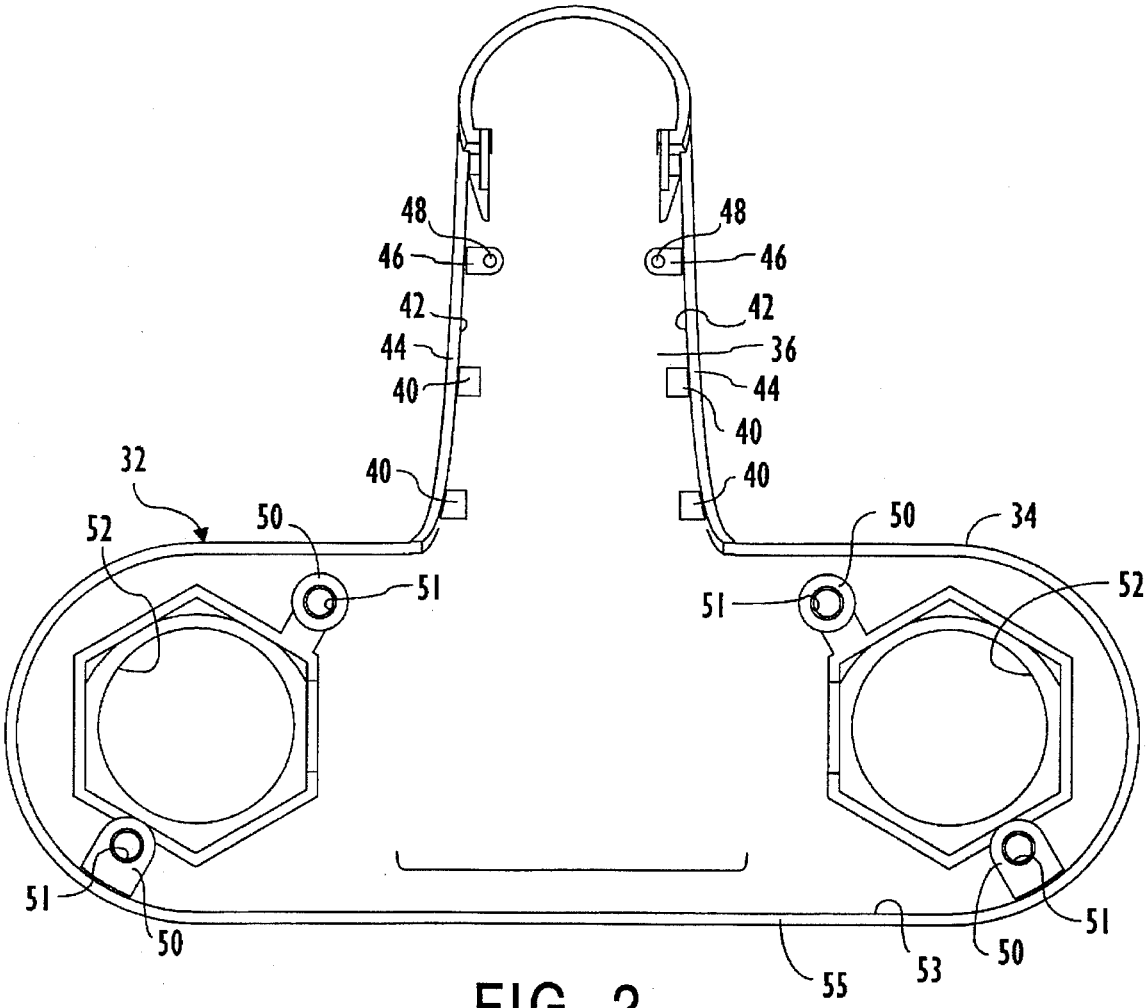
FIG. 2 is a bottom view of a housing of the faucet of FIG. 1 showing structural features thereof in accordance with certain principles of the invention.
Figure 3:
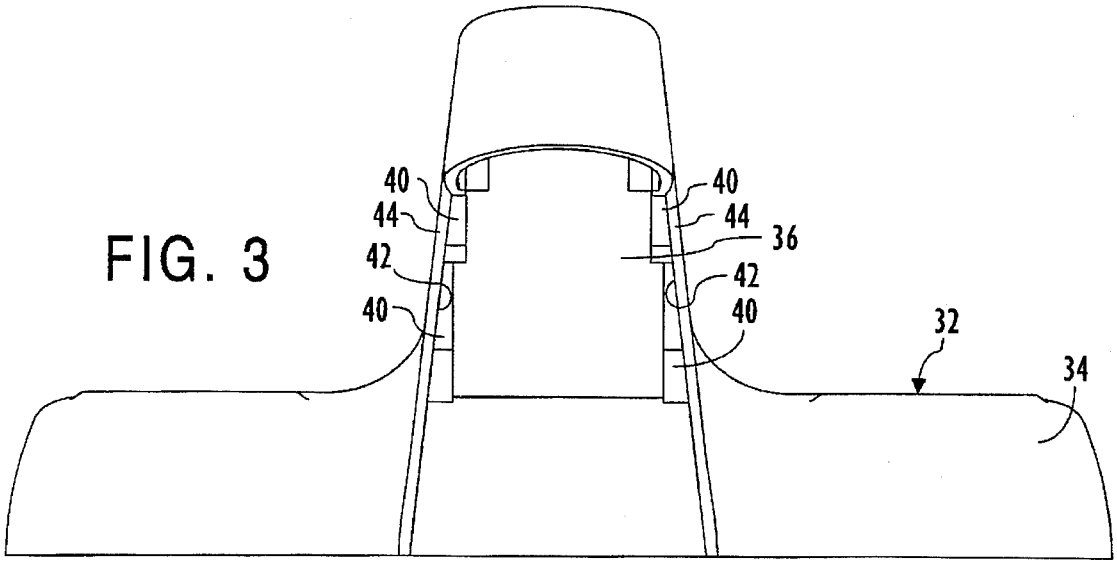
FIG. 3 is a front view of the housing of FIG. 2 showing structural features in accordance with certain principles of the invention.
Figure 4:
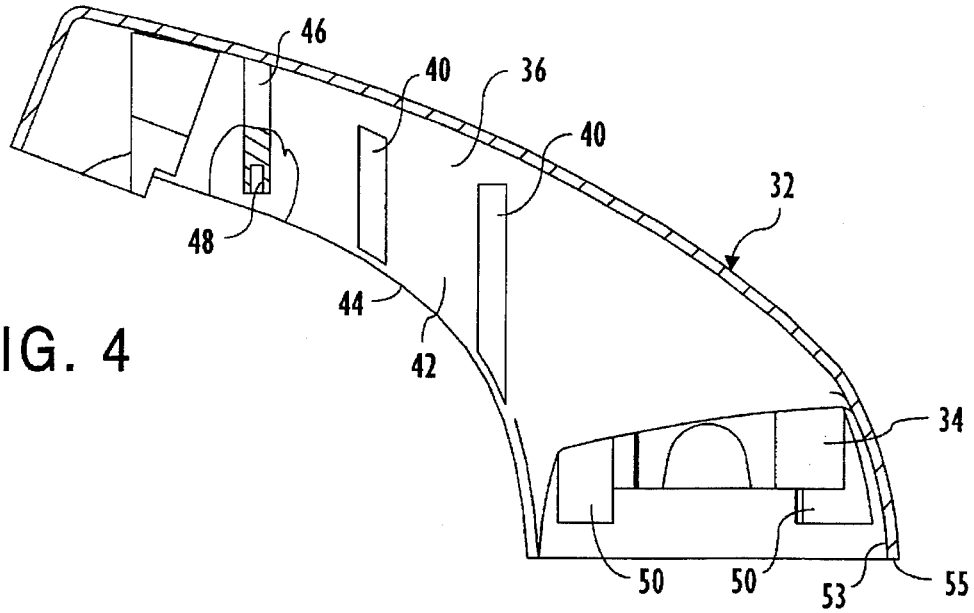
FIG. 4 is a side view of the housing of FIG. 2 showing structural features in accordance with certain principles of the invention.
Figure 5:
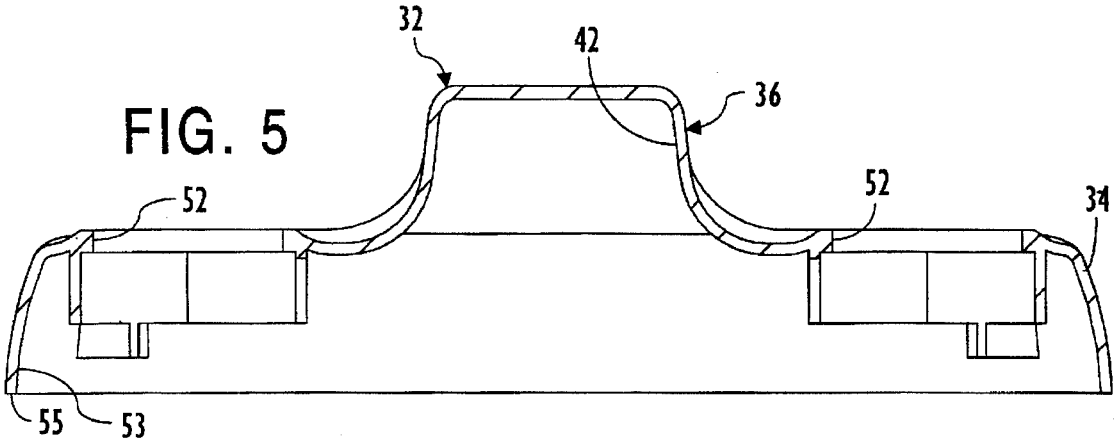
FIG. 5 is a partial sectional view showing structural features of the housing of FIG. 2.

Various views of the shell of the housing 32 are shown in FIGS. 2, 3, 4 and 5. In particular, in FIGS. 2, 3 and 4, several support ribs 40 are formed in an inner wall 42 of the spout 36 with the outer edges of the ribs being slightly recessed from adjacent edges 44 of the spout. A pair of bosses 46 are each formed with a hole 48 and are formed within the spout 36. Two sets of bosses 50 with holes 51 are formed on the inside of the base 34 adjacent a pair of holes 52 which are formed in the base for receipt of valve assemblies (not shown). As shown in FIGS. 2 and 5, the base 34 is formed with an inner opening 53 and has a perimeter edge 55 formed around the opening to define the boundary thereof.

Figure 6:
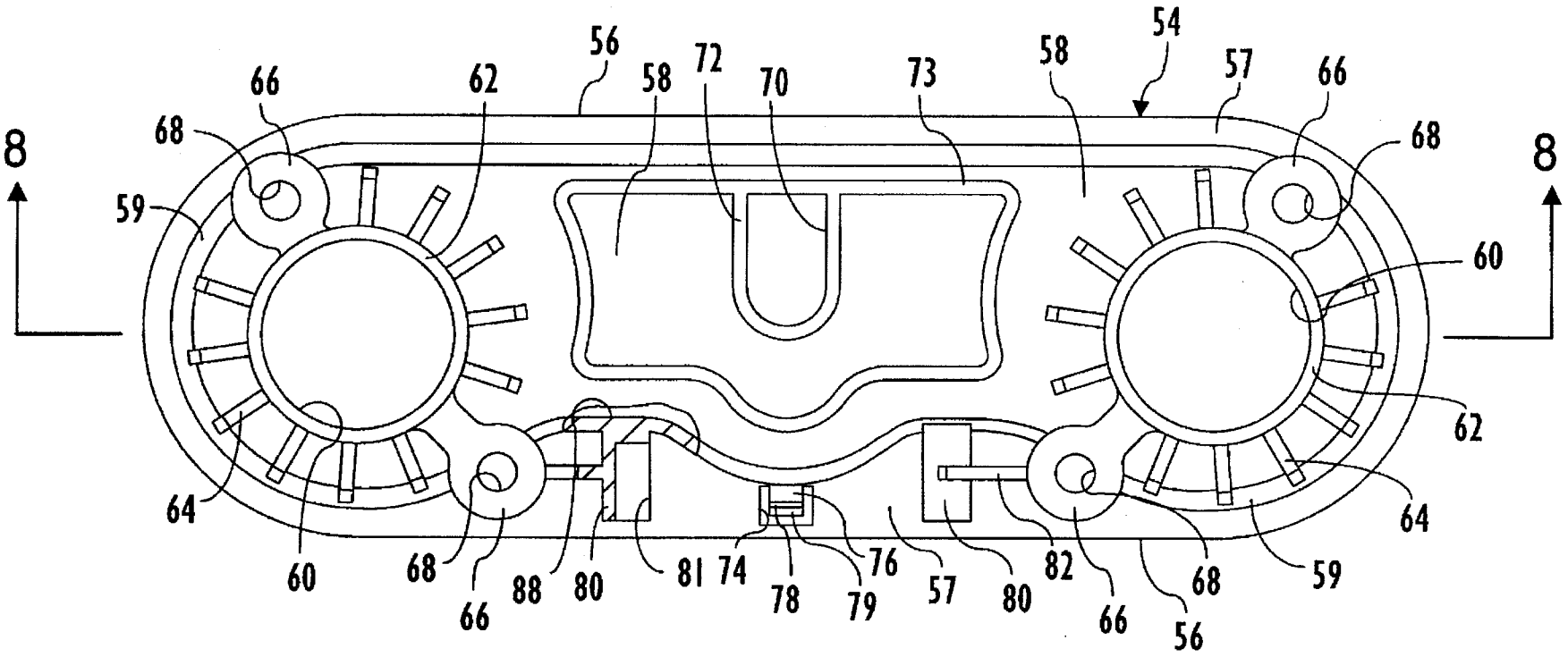
FIG. 6 is a top view showing a putty plate in accordance with certain principles of the invention.
Figure 9:
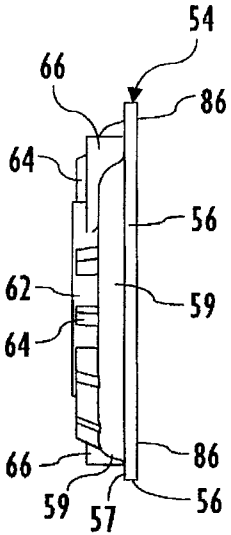
FIG. 9 is a side view of the putty plate of FIG. 6 showing structural features of the putty plate.

A putty plate 54 is shown in FIGS. 6 through 10. The putty plate 54 is composed of a plastic material such as a durable nylon material available from DuPont under the trademark "Zytel" and particularly DuPont's 70G33L "Zytel" material. The putty plate 54 has a perimeter edge 56 which conforms generally to the shape and size of the bottom of the base 34 of the housing 32. As shown in FIG. 6, the putty plate 54 is formed on an inner side thereof with a raised floor 58 which, when assembled with the base 34, will face inward of the base in the manner illustrated in FIG. 17. A ledge 57 is also formed on the inner side of the putty plate 54 contiguous with the perimeter edge 56. The ledge 57 is spaced inboard of the putty plate 54 from the raised floor 58 with a slightly sloping transition surface 59 (FIG. 14) located between the ledge and the raised floor. A pair of holes 60 are formed in the floor 58. Each of the holes 60 is encircled with a circular reinforcing rib 62 and a plurality of radially arranged reinforcing spokes 64.

Figure 14:
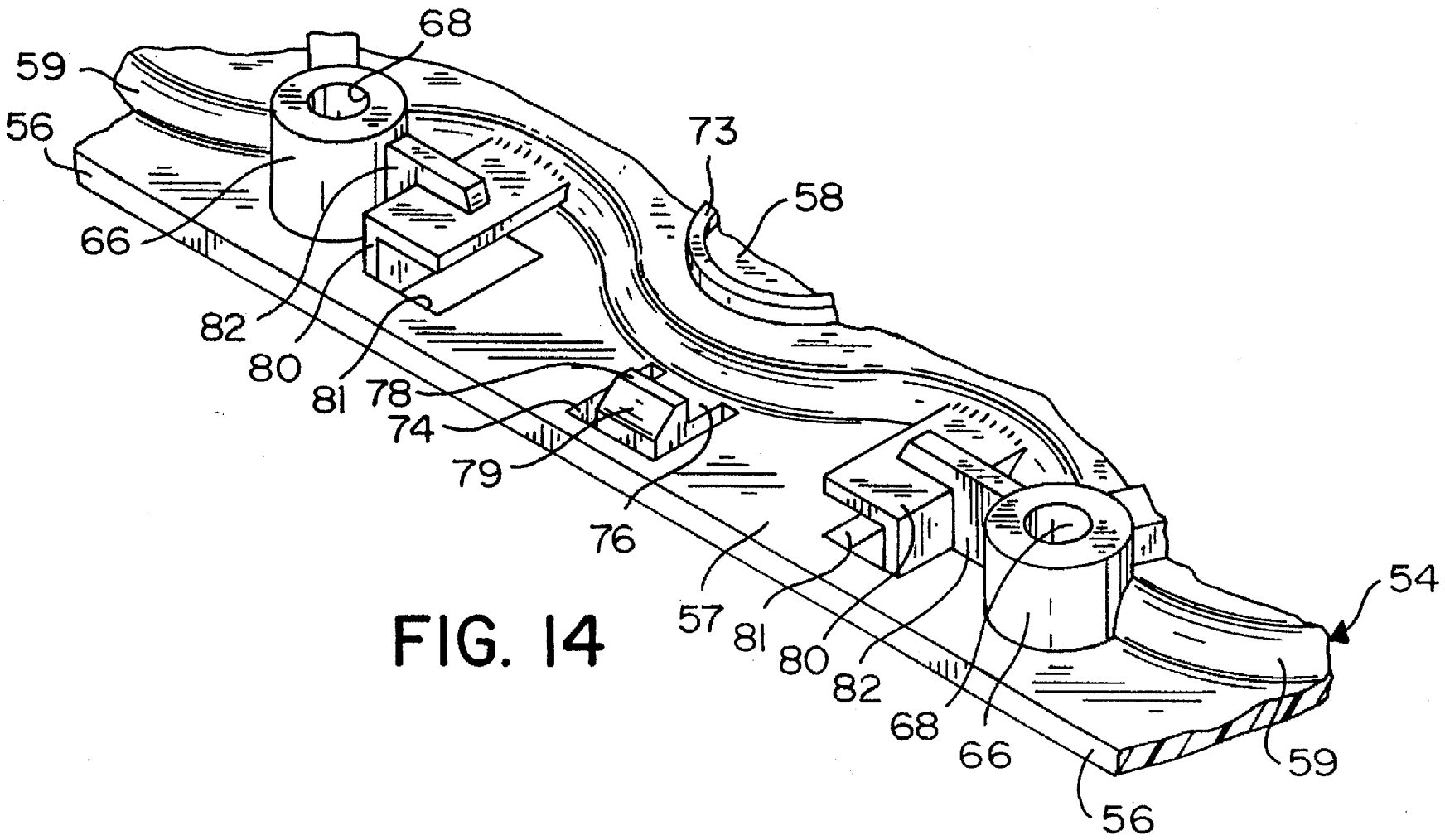
FIG. 14 is a perspective view of a portion of the putty plate of FIG. 6 showing structural features in accordance with certain principles of the invention.

A pair of bosses 66 with holes 68 is formed adjacent each hole 60 and extend from the floor 58 and the ledge 57. An opening 70 is formed generally in the center of the floor 58 and is surrounded by a continuous reinforcing rib 72 which is joined to a larger reinforcing rib 73. As shown in FIGS. 6 and 14, a "U" shaped slot 74 is formed in the ledge 57 and provides an outline for a locking tab 76 with a latch bar 78 formed thereacross. The latch bar 78 is formed with a bevelled slope 79 at a forward or free end thereof. The surface of the tab 76 from which the latch bar 78 extends is flush with the ledge 57 whereby the latch bar extends outward from the surface. A pair of "L" shaped guide channels 80 are formed integrally with ledge 57 adjacent a respective hole 81 formed in the ledge 57 and are located on either side of the tab 76. Each of the channels 80 are also integrally joined to the plate 54 through a respective linking bar 82. It is noted that the channels 80 and the respective linking bars 82 are formed as an integral portion of the plate 54 during the molding of the plate. Also, the rear of the channels 80 are integrally molded with the adjacent portion of the slope 59.

Figure 7:
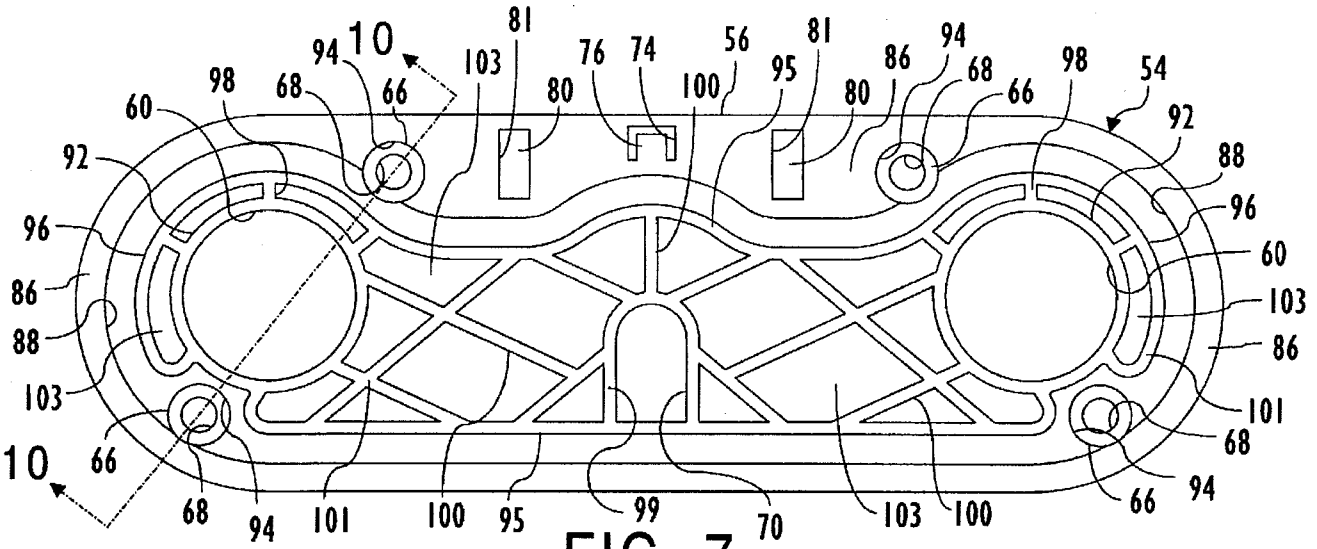
FIG. 7 is a bottom view of the putty plate of FIG. 6 showing structural features in accordance with certain principles of the invention.

Referring to FIG. 7, an outer side of the plate 54 is formed with a ledge 86. A continuous groove 88 is formed around an inner perimeter of the ledge 86. The outer slope of the groove 88, which is adjacent the ledge 86, forms the inner wall of the slope 59 (FIG. 14) which is formed on the outer side of the putty plate 54. Circular reinforcing ribs 92 are formed about the holes 60 while recesses 94 are formed about the holes 68. A pair of arcing ribs 96 are each formed spatially adjacent a portion of a respective one of the ribs 92 and are contiguous with the groove 88. A plurality of ribs 98 integrally link each of the arcing ribs 96 with the respective rib 92. A rib 99 surrounds hole 70 and is joined with a honeycomb pattern of integrally joined ribs 100 which are located generally between the holes 60 and about the hole 70. The inner slope of groove 88 defines a closed boundary for a floor 103 located within spaces defined, and not occupied, by the ribs 92, 96, 98, 99 and 100. The floor 103 is flush with the ledge 86.

Figure 8:
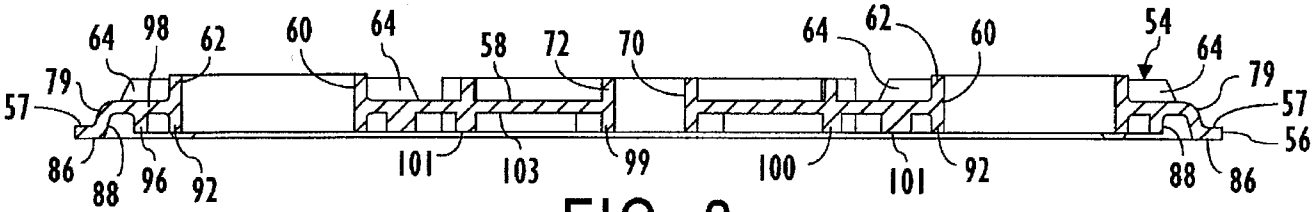
FIG. 8 is a sectional view taken along line 8—8 of FIG. 6 showing structural features of the putty plate of FIG. 6.
Figure 10:
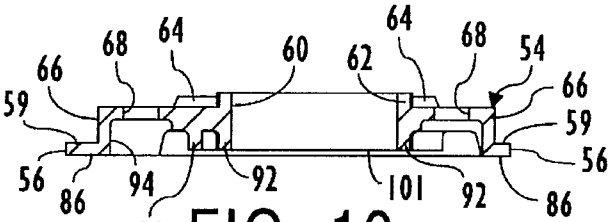
FIG. 10 is a sectional view taken along line 10—10 of FIG. 7 showing structural features of the putty plate of FIG. 6.

It is noted that all of the ribs 62, 72, 73, 92, 96, 98, 99 and 100, and the spokes 64, are integral components of the putty plate 54 and are joined to provide an exceptional strengthening arrangement for the putty plate. It is further noted that, as illustrated in FIG. 8, an integrally formed common edge 101 of the ribs 92, 96, 98, 99 and 100 is slightly recessed inward from the perimeter ledge 90.

The putty plate 54 is composed of a durable material as noted above which provides a strengthening enhancer for faucet 30. The various structures including ribs, spokes and the like further enhance the strengthening attribute of the plate 54. When combining the type of material and the thickness of the plate 54, the plate assumes a generally rigid character which provides considerable stability for the faucet 30. The spaces defined by the ribs 92, 96, 98, 99, the honeycomb pattern of ribs 100 and the groove 88 provide a location for an application of putty when the faucet 30 is assembled on a counter top.

Figure 11:
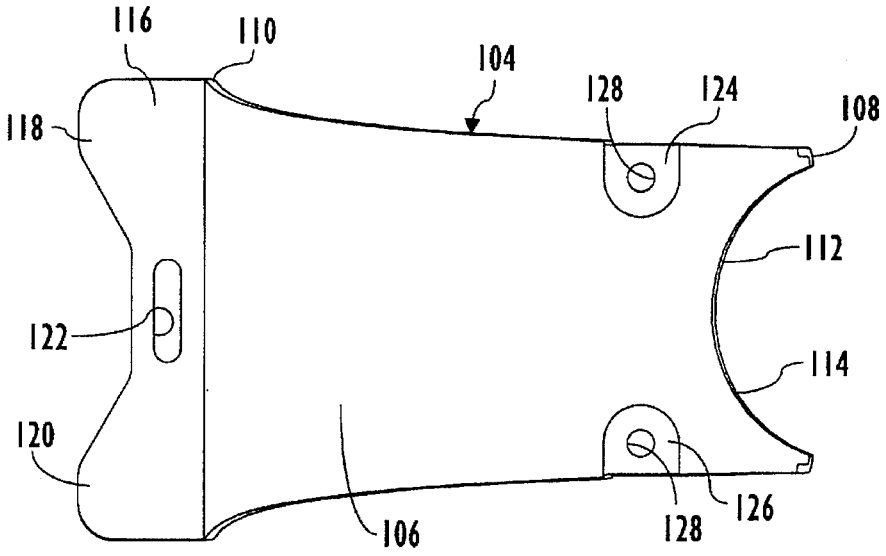
FIG. 11 is a top view of a throat plate showing structural features in accordance with certain principles of the invention.
Figure 12:
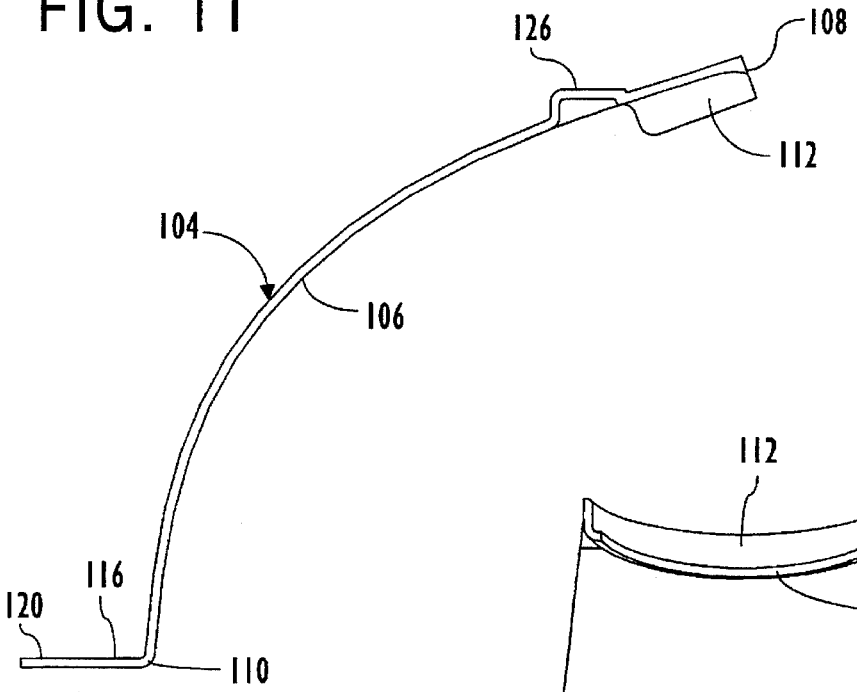
FIG. 12 is a side view of the throat plate of FIG. 11 showing structural features in accordance with certain principles of the invention.
Figure 13:
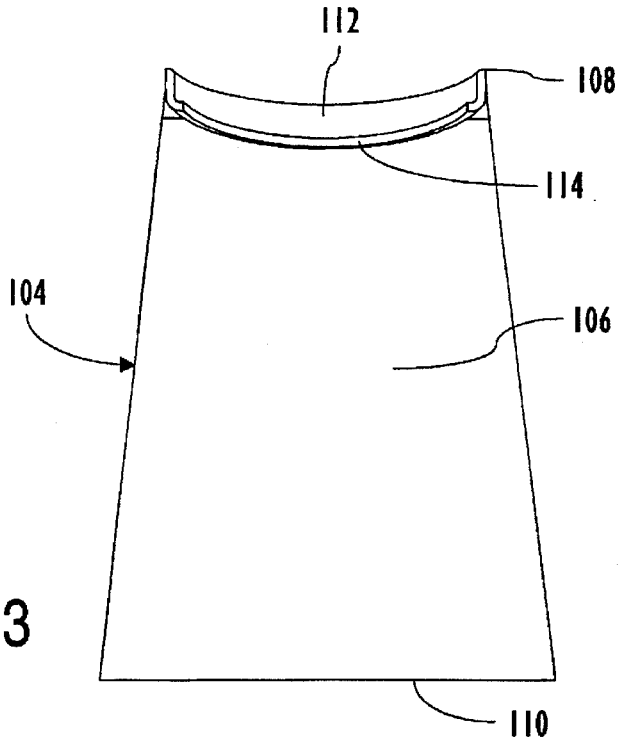
FIG. 13 is a front view of the throat plate of FIG. 11 showing structural features thereof.

A throat plate 104 for faucet 30 is illustrated in FIGS. 11, 12 and 13. The plate 104 is formed with a center body 106 which has a curved shape from a first end 108 to a second end 110. A side-to-side curved wall 112 is formed at end 108 and has a lip 114 extending therefrom. A ledge 116 extends from the end 110 and is formed with two spaced tabs 118 and 120 and an elongated hole 122. A pair of bosses 124 and 126 extend outward from the convex side of spaced edge portions of the center body 106 adjacent the curved wall 112. Each of the bosses 124 and 126 are formed with a hole 128.

Figure 15:
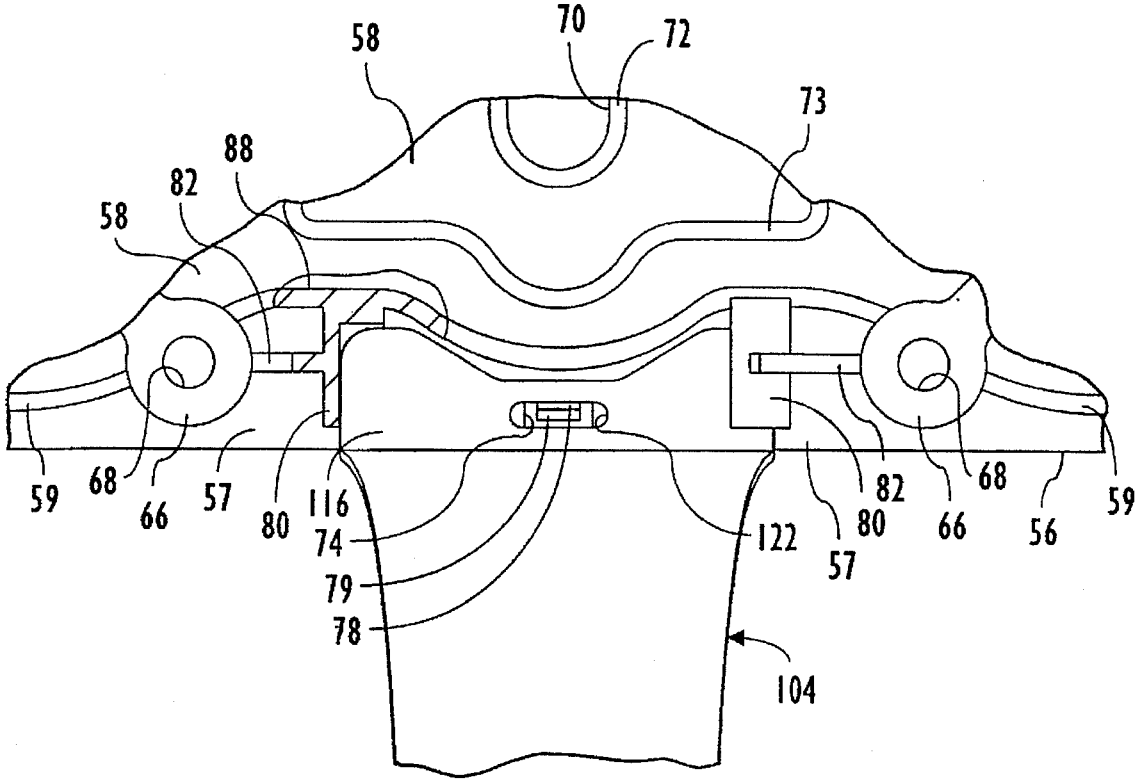
FIG. 15 is a top view of a portion of the putty plate of FIG. 6 in assembly with the throat plate of FIG. 11 in accordance with certain principles of the invention.

Referring to FIG. 15, the throat plate 104 is assembled with the putty plate 54 in accordance with the preferred embodiment of the invention by first placing the tabs 118 and 120 of ledge 116 on the ledge 57 in alignment with the channels 80 and with hole 122 in alignment with the locking tab 76. The throat plate 104 is then moved so that tabs 118 and 120 are moved into the channels 80 and the portion of the ledge 116 which is forward of the hole 122 engages the bevelled slope 79 of the latching bar 78 to depress the tab 76 and the bar. This allows the tabs 118 and 120 to move further into the channels 80 until the latching bar 78 is aligned with the hole 122 whereby the latching bar is biased into the hole to effectively latch the throat plate 104 with the putty plate 54. If the throat plate 104 must be removed from assembly with the putty plate 54, the tab 76 is depressed and the plate is moved in the reverse direction until the tabs 118 and 120 are clear of the channels 80.

Figure 23:
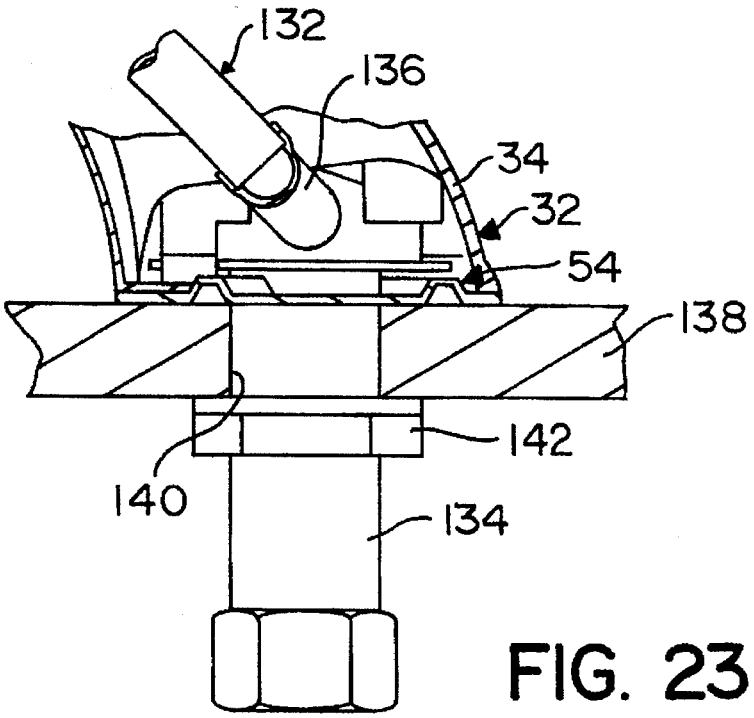
FIG. 23 is a partial sectional view showing the faucet of FIG. 1 in assembly with a counter top.
Figure 24:
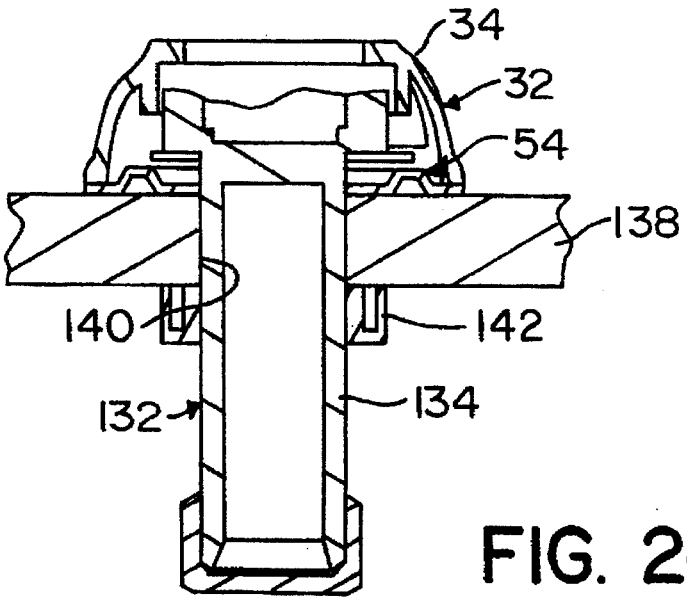
FIG. 24 is a partial sectional view showing the faucet of FIG. 1 in assembly with the counter top of FIG. 23.

An underbody assembly 132 (FIGS. 23 and 24) is assembled with and secured to the base 34 of the faucet housing 32 and includes a pair of spaced end bodies 134 (FIGS. 23 and 24) connected to a "T" shaped copper tube assembly 136 (FIG. 23) for directing water from the end bodies to the water dispensing end of the spout 36. A portion of the end bodies 132 extend through the holes 52 of the base 34 and support valves (not shown) which, in turn, are assembled with the handles 38.

Figure 16:
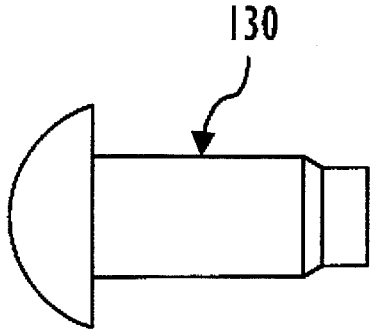
FIG. 16 is a side view showing a drive screw.
Figure 17:
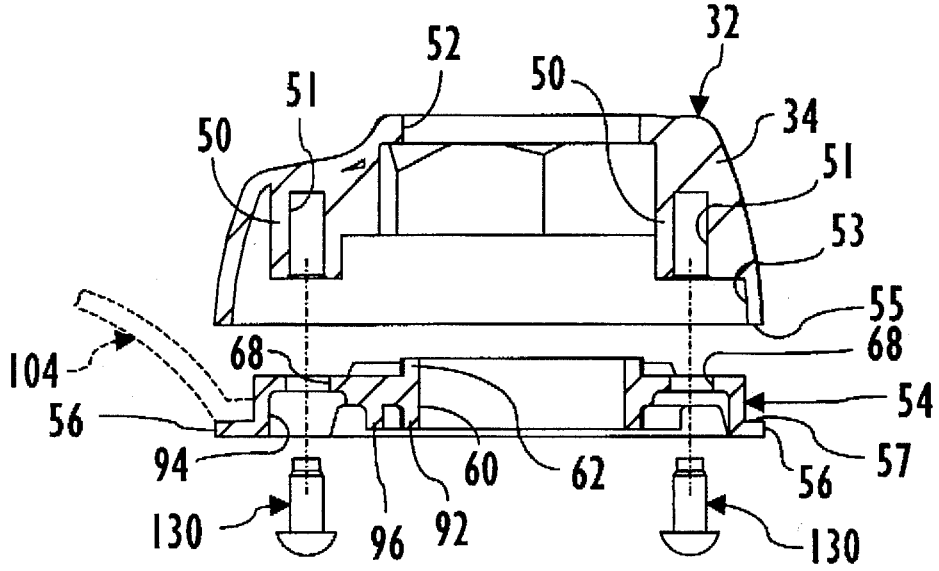
FIG. 17 is an exploded sectional view showing the putty plate of FIG. 6 and the assembled throat plate (in phantom) of FIG. 11 in position for assembly with, and attachment to, the housing of FIG. 2 by use of the drive screws of FIG. 16 in accordance with certain principles of the invention.

As shown in FIG. 16, a round head metallic drive screw 130 is used as illustrated in FIG. 17 to secure the putty plate 54, which is connected to the throat plate 104 (shown partially in phantom), with the base 34 of the housing 32. In particular, holes 60 of the putty plate 54 are moved relatively over the end bodies 132 from the underside of the housing 32. The holes 68 of the putty plate 54 are thereby aligned with respective holes 51 of the base 34 and the putty plate is inserted into the opening 53 of the base. Eventually, perimeter edge 55 of the base 34 engages the adjacent perimeter portions of the floor 58 of the putty plate 54 and the drive screws 130 are driven into the openings 51 to secure the putty plate with the housing 32.

As the putty plate 54 is positioned in assembly with the base 34 as described above, the center body 106 of the throat plate 104 fits into a space defined by the wall 42 of the spout 36. Portions of the edges of the center body 106 rest on the recessed outer ends of the ribs 40 which are formed on the walls 42. In addition, the tops of the bosses 126 which extend from the convex surface (FIG. 12) are moved into engagement with the bosses 46 formed on the wall 42 of the spout 36. Screws are then placed through the holes 128 of the throat plate 104 and are threadedly mounted into holes 48 of the spout 36 to secure the throat plate with the spout.

Referring again to FIGS. 23 and 24, faucet 30 can be assembled on and secured to a counter top 138 by inserting the end bodies 134 through openings 140 in the counter top from the top thereof so that the lower portion of the end bodies extend below the counter top. A nut 142 is then placed over the lower portion of each respective end body 134 and threadedly secured under the counter top 138 to secure the faucet 30 to the counter top.

Figure 18:
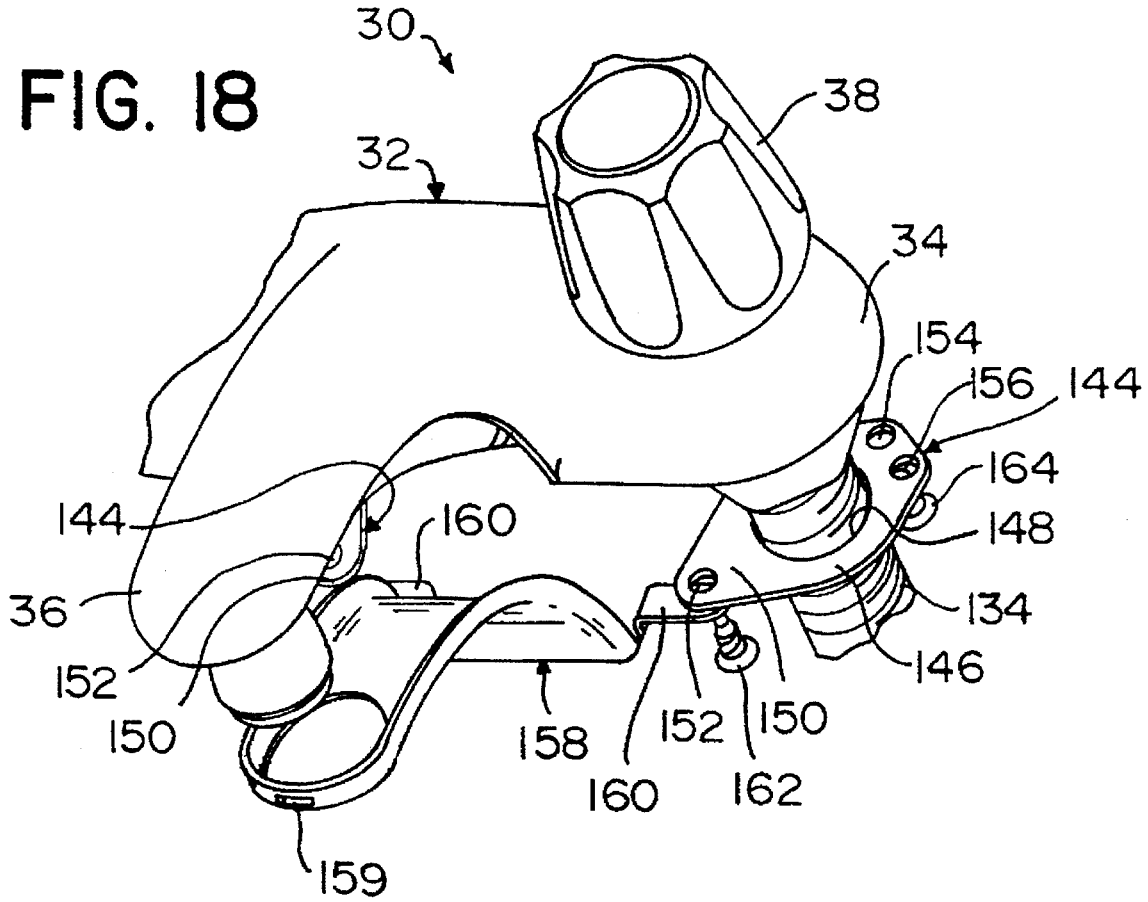
FIG. 18 is a partial perspective view showing a throat plate, a bracket and a faucet housing in position for assembly in accordance with certain principles of the invention.

Another embodiment of the invention includes a bracket 144 as shown in FIG. 19. The bracket 144 includes a flat body 146 having a circular hole 148 and an ear 150 extending outward from one end thereof. One hole 152 is formed through the ear 150 and a pair of adjacent holes 154 and 156 are formed through the body 146 at the end opposite the ear. As shown in FIG. 18, the bracket 144 is manipulated to move the circular hole 148 over the lower portion of the end body 134. The bracket 144 is moved into the bottom opening of the base 34 to seat the areas of the bracket which include the holes 152 and 156 on respective ones of a pair of bosses (not shown) formed inside the shell of the faucet housing 32 to align the holes 152 and 156 with holes in the bosses. The bosses with holes formed in the housing 32 of FIG. 18 are similar to the bosses 50 with holes 51 as shown in FIG. 2. A throat plate 158 is formed with a hole 159 in a forward end thereof which is positionable over a pin-like projection (not shown) formed from an inside wall at the forward end of the spout 36 to retain the forward end of the throat plate with the spout. The throat plate 158 also has a first tab 160 formed integrally therewith from a single piece of material which is positioned so that a hole (not shown) in the tab is aligned with the hole 152 in the bracket 144 and the hole in the respective boss within the housing 32. A first screw 162 is then inserted through the hole in the tab 160, through the hole 152 in the bracket 144 and threadedly into the hole in the respective boss within the housing 32. A second screw 164 is inserted through the hole 156 in the bracket 144 and into the hole in the respective boss within the housing 32. A second bracket 144 and a second tab 160 are located on the other side of the housing 32 for assembly therewith in identical fashion. This completes the assembly of the throat plate 158 with the housing 32 in accordance with certain principles of the invention.

In another embodiment of the invention shown in FIG. 20, an underbody assembly includes a center body 166 and a pair of copper tubes 168 secured thereto. The opposite ends of the copper tubes 168 are secured to a respective one of a pair of end bodies similar to the end body 134 (FIG. 18) which are connected to water supply conduits. Water is supplied through the end bodies and copper tubes 168 to a water passage 170 within the center body 166 and then to a spout (not shown) which is assembled to the top of the center body. A putty plate 172, which is similar to putty plate 54, is formed with a recess 174 in an underside thereof and a hole 176 which extends from the top of the putty plate into communication with the recess. A pin 178 is formed integrally at the bottom of the center body 166 and is inserted into the hole 176 and extends into the recess 174 of the putty plate 172. A press nut 180 is pressed onto the pin 178 from the bottom of the putty plate 172 and into the recess 174 to assist in securing the putty plate with the center body 166 and the underbody assembly. As shown in FIGS. 21 and 22, the press nut 180 is formed from a single piece of metal including a flat body 182, a pair of outward-turned interfacing tabs 184 are formed above a hole 186 in the body. Each of the tabs 184 is formed with a "V" shaped notch 188 which are interfacing. As shown in FIG. 20, the press nut 180 is positioned with the tabs 184 extending downward. The hole 186 is moved over the pin 178 of the center body 166 whereby the notches 188 engage and are dragged over the pin and the flat body 182 is pressed firmly against a ceiling 190 of the recess 174 of the putty plate 172. The angle of the tabs 184 relative to the flat body 182 and the pin 178 facilitates retention of the putty plate 172 with the center body 166.

In general, the above-identified embodiments are not to be construed as limiting the breadth of the present invention. Modifications, and other alternative constructions, will be apparent which are within the spirit and scope of the invention as defined in the appended claims.

What is claimed is:

1. A faucet, which comprises:

a putty plate;

a throat plate attached to the putty plate to form an assembly thereof;

a housing formed in a shell-like configuration with an opening;

the assembly of the putty plate and the throat plate being connected to the housing at the opening thereof;

a ledge formed on the putty plate;

a tab formed in the ledge thereof and joined to the ledge on one side thereof to facilitate attachment of the putty plate to the throat plate; and a latch bar located on the tab.

2. The faucet as set forth in claim 1, wherein the housing comprises;

a base section having an opening for receipt of the putty plate therein;

a spout section formed integrally with the base section and extending therefrom with an opening for receipt of the throat plate; and the openings of the base section and the spout section forming the opening of the housing.

3. The faucet as set forth in claim 2, which further comprises:

the spout section formed generally with a pair of spaced side walls and a top wall extending between spaced portions of the spaced side walls;

the spout section formed with a pair of spaced edges with each of the edges located on an end of a respective one of the side walls thereof adjacent the opening of the spout section;

the spout section being formed with at least a pair of ribs with each rib formed on an inside surface of a respective one of the side walls of the spout section; and an edge of each of the ribs adjacent the opening of the spout section being recessed by a prescribed distance from the respective edge of the side wall of the spout section.

4. The faucet as set forth in claim 3, wherein the throat plate comprises a body which fits into the opening of the spout section and engages the edge of each of the ribs.

5. The faucet as set forth in claim 2, which further comprises:

the spout section formed generally with a pair of spaced side walls and a top wall extending between spaced portions of the spaced side walls;

the spout section formed with a pair of spaced edges with each of the edges located on an end of a respective one of the side walls thereof adjacent the opening of the spout section;

the spout section being formed with a pair of bosses with each boss formed on an inside surface of a respective one of the side walls of the spout section;

an edge of each of the bosses adjacent the opening of the spout section being recessed by a prescribed distance from the respective edge of the side wall of the spout section; and a hole formed in the edge of each of the bosses.

6. The faucet as set forth in claim 5:

wherein the throat plate comprises a body and a pair of bosses having holes therethrough formed in the body at prescribed locations;

wherein the holes of the bosses of the throat plate are aligned with the holes of the bosses of the spout section; and which further comprises a pair of fasteners located through the holes of the bosses of the throat plate and threadedly into the holes of the bosses of the spout section.

7. The faucet as set forth in claim 6:

wherein the putty plate is formed with at least one opening therethrough;

wherein the housing is formed with at least one boss having a hole formed therein; and which further comprises the opening of the putty plate being aligned with the hole of the housing and a fastener located through the opening of the putty plate and into the hole of the housing.

8. The faucet as set forth in claim 1, wherein the throat plate comprises:

a body;

a ledge extending from the body at one end thereof; and complementary structure formed on the ledge for aligning and attaching the throat plate directly to the putty plate.

9. The faucet as set forth in claim 8, wherein the complementary structure of the throat plate includes an opening of a prescribed shape formed through the ledge of the throat plate at a prescribed location.

10. The faucet as set forth in claim 1, wherein the putty plate is formed with complementary structure on the ledge thereof, and wherein the throat plate further comprises:

a body;

a ledge extending from the body at one end thereof; and complementary structure formed on the ledge for aligning and attaching the throat plate directly to the complementary structure of the putty plate.

11. The faucet as set forth in claim 10, wherein the complementary structure of the throat plate includes a pair of spaced tabs which extend in a common direction from an edge of the ledge of the throat plate.

12. The faucet as set forth in claim 1, wherein the throat plate comprises:

a body; and a pair of bosses having holes therethrough formed in the body at prescribed locations.

13. A faucet, which comprises:

a putty plate;

a throat plate attached to the putty plate to form an assembly thereof;

a housing formed in a shell-like configuration with an opening;

the assembly of the putty plate and the throat plate being connected to the housing at the opening thereof; and wherein the putty plate comprises:

a base wall of a prescribed thickness with a first surface on one side of the wall and a second surface on the other side of the wall;

a first plurality of integrally-joined ribs integrally formed with and extending inward of the housing from the first surface of the base wall in a first prescribed pattern;

a second plurality of integrally-joined ribs integrally formed with and extending outward of the housing from the second surface of the base wall in a second prescribed pattern;

a continuous groove formed in the base wall in a continuous pattern which defines a perimeter of the first and second surfaces of the base wall;

at least one hole formed through the base wall; and a rib surrounding at least a portion of the at least one hole.

14. A faucet, which comprises:

a putty plate;

a throat plate attached to the putty plate to form an assembly thereof;

a housing formed in a shell-like configuration with an opening;

a ledge formed on the putty plate;

the assembly of the putty plate and the throat plate being connected to the housing at the opening thereof;

the putty plate comprised a complementary structure which includes a pair of interfacing "L" shaped channels formed on the ledge of the putty plate; and the throat plate comprises a body, a ledge extending from the body at one end thereof and complementary structure formed on the ledge for aligning and attaching the throat plate directly to the putty plate.

15. The faucet as set forth in claim 14:

wherein the complementary structure of the throat plate includes a pair of spaced tabs which extend in a common direction from an edge of the ledge of the throat plate and are located within the "L" shaped channels of the putty plate.

16. A faucet, which comprises:

a putty plate;

a throat plate attached to the putty plate to form an assembly thereof;

a housing formed in a shell-like configuration with an opening;

the assembly of the putty plate and the throat plate being connected to the housing at the opening thereof;

a ledge formed on the putty plate;

the throat plate comprises a body, a ledge extending from the body at one end thereof and complementary structure formed on the ledge and includes an opening of a prescribed shape formed through the ledge at a prescribed location for aligning and attaching the throat plate directly to the putty plate; and the putty plate further comprises complementary structure which includes a tab formed in and joined along one edge thereof to the ledge of the putty plate and a latch bar on the tab located in the opening of the throat plate.

17. The faucet as set forth in claim 16:

wherein the complementary structure of the putty plate further includes a pair of interfacing "L" shaped channels formed on the ledge of the putty plate; and wherein the complementary structure of the throat plate further includes a pair of spaced tabs which extend in a common direction from an edge of the ledge of the throat plate and are located within the "L" shaped channels of the putty plate.

18. A faucet which comprises:

a housing formed in a shell-like configuration with an opening;

putty plate;

an element structured for assembly with the putty plate;

a coupling structure for attaching the putty plate to the element to form an assembly thereof;

securing members for securing the assembly of the putty plate and the element within the opening of the housing; and wherein the coupling structure comprises:

a hole formed through the putty plate;

a stem formed on the element and located through the hole of the putty plate; and a fastener positioned over the stem to preclude the stem and the element from movement relative to the putty plate.

19. The faucet as set forth in claim 18, wherein the fastener is a press nut.

* * * * *